United States Patent [19]

Parikh et al.

[11] 4,110,132

[45] Aug. 29, 1978

[54] IMPROVED COPPER BASE ALLOYS

[75] Inventors: Prakash D. Parikh; Eugene Shapiro, both of Hamden, Conn.

[73] Assignee: Olin Corporation, New Haven, Conn.

[21] Appl. No.: 812,879

[22] Filed: Jul. 5, 1977

Related U.S. Application Data

[63] Continuation-in-part of Ser. No. 727,728, Sep. 29, 1976, Pat. No. 4,047,978, which is a continuation of Ser. No. 568,870, Apr. 17, 1975, abandoned.

[51] Int. Cl.[2] ..... C22C 9/01; C22F 1/08

[52] U.S. Cl. ..... 148/32; 148/11.5 C

[58] Field of Search ..... 148/32, 11.5 C, 12.7 C

[56] References Cited

U.S. PATENT DOCUMENTS

| | | | |
|---|---|---|---|
| 2,676,123 | 4/1954 | Gregory | 148/11.5 C |
| 2,804,408 | 8/1957 | Gregory | 148/11.5 C |
| 3,816,187 | 6/1974 | Smith et al. | 148/11.5 C |
| 3,841,921 | 10/1974 | Shapiro et al. | 148/11.5 C |
| 3,993,479 | 11/1976 | Cheskis et al. | 148/11.5 C |

*Primary Examiner*—W. Stallard

*Attorney, Agent, or Firm*—Paul Weinstein; Robert A. Dawson

[57] ABSTRACT

The instant disclosure teaches a process for obtaining an improved combination of strength and bend properties in copper base alloys having low stacking fault energy. The process is characterized by a critical combination of cold reduction and annealing following recrystallization. Improved copper base alloys are also disclosed.

6 Claims, No Drawings

IMPROVED COPPER BASE ALLOYS

CROSS REFERENCE TO RELATED APPLICATION

This case is a continution-in-part of copending application U.S. Ser. No. 727,728, filed Sept. 29, 1976, now U.S. Pat. No. 4,047,978, granted Sept. 13, 1977, which in turn is a continuation-in-part of U.S. Ser. No. 568,870, filed Apr. 17, 1975, now abandoned.

BACKGROUND OF THE INVENTION

It is highly desirable to provide copper base alloys with a good combination of strength and bend properties, particularly while retaining the other advantageous properties of these alloys.

The usefulness of sheet materials is often limited by their ability to be formed by bending into the desired shape. This is particularly true when cold rolling is employed in order to strengthen the strip material since the cold working reduces bend ductility. In addition, cold rolling also leads to anisotropy in bend behavior where a lower bend ductility is observed when measured with the bend axis parallel to the rolling direction, that is, when the bend ductility is measured with the bend axis 0° to the rolling direction. Thus, the most desirable combination of properties is extremely difficult to achieve, that is, high bend ductility without anisotropy combined with high strength properties.

Cold rolling of copper base alloys having a low stacking fault energy promotes an unfavorable deformation texture in the alloy and this texture contributes to anisotropy in mechanical properties, including bend ductility. The intensity and the characteristics of the deformation texture are described by the plastic strain ratio R measured at 0°, 45° and 90° to the rolling direction.

Accordingly, it is a principal object of the present invention to provide a process for obtaining a combination of good strength and good bend properties in copper base alloys having low stacking fault energy.

It is a still further object of the present invention to provide a process as aforesaid which is convenient to use on a commercial scale and which allows the retention of other desirable properties in these alloys.

It is a particular object of the present invention to provide a process as aforesaid which enables one to obtain high bend ductility without anisotropy combined with good strength properties.

Further objects and advantages of the present invention will appear from the ensuing specification.

SUMMARY OF THE INVENTION

In accordance with the present invention it has now been found that the foregoing objects and advantages may be readily obtained.

The process of the present invention obtains an improved combination of strength and bend properties in copper base alloys having low stacking fault energy by employing a critical combination of annealing and cold reduction in the final steps of the processing cycle to achieve a non-random texture with a low R value measured at 90° to the rolling direction, that is, perpendicular to the rolling direction. The quantity R is an indicator of texture. The R value is the ratio of width strain to the thickness strain during tensile testing. For an isotropic material, R equals one and the degree of thinning of a tensile specimen is equal to the degree of narrowing. For R values greater than one (a texture present), the thinning is proportionally less than the narrowing during tension. For R values less than one (a texture present), the reverse is true. Thus R represents the effect of a texture on the geometry changes resulting from deformation. The value for R can be determined mathematically in accordance with the following equations:

$$R = \epsilon_w/\epsilon_t \tag{1}$$

$$\frac{\epsilon_w}{\epsilon_t} = \frac{l_n \frac{w_f}{w_o}}{l_n \frac{t_f}{t_o}} \tag{2}$$

where $\epsilon_w$ represents the width strain, $\epsilon_t$ represents the thickness strain. These values can be determined in accordance with equation (2) by measuring the original and final widths, with $w_o$ representing the original width and $w_f$ representing the final width, and by measuring the original thickness and final thickness, with $t_o$ representing the original thickness and $t_f$ representing the final thickness in accordance with ASTM standard E517-74. The designation $l_n$ represents the natural logarithm.

The copper base alloys processed in accordance with the present invention have a stacking fault energy of less than 30 ergs per square centimeter and contain a first element selected from the group consisting of about 2 to 12% aluminum, about 2 to 6% germanium, about 2 to 10% gallium, about 3 to 12% indium, about 1 to 5% silicon, about 4 to 12% tin, about 8 to 37% zinc, and the balance essentially copper. In accordance with the process of the present invention one provides the aforesaid copper base alloy in the fully recrystallized condition and with a fine grain size of less than 0.015 mm. The fully recrystallized, fine grained copper base alloy is cold rolled at least 60% and preferably at least 70%, annealed at a metal temperature of from 280° C. to 425° C. preferably for a period of time of at least 15 minutes and less than 48 hours to obtain a non-random texture with a plastic strain ratio R measured 90° to the rolling direction of less than 0.75; and finally cold worked less than 40%.

Standard processing of these materials results in a nearly random texture following the RF (ready to finish) anneal so that isotropy of the mechanical properties results. In accordance with standard processing the R values for the resultant material are similar in all three directions of the sheet, meaning that the texture is random. Metal with this random annealed texture is generally cold rolled to obtain temper rolled metal. On the other hand, it is a surprising finding of the present invention that one obtain a non-random texture after the RF anneal such that the R value is lowest in the 90° direction (perpendicular to the rolling direction). Such a texture is highly desirable and is in fact required in order to obtain improvements in the rolled tempers.

DETAILED DESCRIPTION

In accordance with the process of the present invention, the copper base alloys have a stacking fault energy of less than 30 ergs per square centimeter. The alloys contain a first element selected from the group consisting of about 2 to 12% aluminum, preferably 2 to 10% aluminum, about 2 to 6% germanium, preferably 3 to 5% germanium, about 2 to 10% gallium, preferably 3 to 8% gallium, about 3 to 12% indium, preferably 4 to 10% indium, about 1 to 5% silicon, preferably 1.5 to 4% silicon, about 4 to 12% tin, preferably 4 to 10% tin, and about 8 to 37% zinc, preferably 15 to 37% zinc.

The balance of the alloy is essentially copper. Naturally, the alloy may include further alloying additions. For example, the alloy may include at least one second element different from the first element, the second element being selected from the group consisting of about 0.001 to 10% aluminum, about 0.001 to 4% germanium, about 0.001 to 8% gallium, about 0.001 to 10% indium, about 0.001 to 4% silicon, about 0.001 to 10% tin, about 0.001 to 37% zinc, about 0.001 to 25% nickel, about 0.001 to 0.4% phosphorus, about 0.001 to 5% iron, about 0.001 to 5% cobalt, about 0.001 to 5% zirconium, about 0.001 to 10% manganese and mixtures thereof.

The preferred amounts of said second element are as follows: about 0.01 to 4% aluminum, about 0.01 to 3% germanium, about 0.01 to 7% gallium, about 0.01 to 9% indium, about 0.01 to 3.5% silicon, about 0.01 to 8% tin, about 0.01 to 35% zinc, about 0.01 to 20% nickel, about 0.01 to 35% phosphorus, about 0.01 to 3.5% iron, about 0.01 to 2% cobalt, about 0.01 to 3.5% zirconium, and about 0.01 to 8.5% manganese.

With respect to the second element or elements, the use of aluminum, silicon, tin or zinc is effected to reduce the stacking fault energy of the alloy as disclosed in U.S. Pat. No. 3,841,921. Nickel, iron, cobalt, zirconium and manganese are effective to reduce the grain size of the alloy. The nickel and manganese are also effective as solid solution hardeners without substantially effecting the stacking fault energy of the alloy. Phosphorus acts as both a deoxidant and as a grain refiner, either singly or in combination with the other elements.

In accordance with the present invention, the casting and hot rolling steps are not particularly critical. Thus, the alloy may be cast in any desired or convenient manner and hot rolled as desired to break up the cast structure and obtain the desired gage for subsequent processing.

In accordance with the process of the present invention one must provide the copper base alloy in the fully recrystallized form and having a fine grain size of less than 0.015 mm. Naturally, the exact conditions for providing this combination of full recrystallization and fine grain size may vary depending upon the particular alloy and its particular alloying ingredients. In general, however, one provides a recrystallization anneal at a metal temperature of from 370° C. to 600° C. preferably for at least 15 minutes and generally less than 24 hours. One can use either bell or continuous strip annealing techniques. When continuous strip annealing techniques are employed, one uses very short treatment times at higher temperatures, with the treatment being selected so that the resultant effect on the metal is as if the metal were subjected to a temperature of from 370° C. to 600° C. for at least 15 minutes, i.e., the metal temperature is effectively from 370° C. to 600° C. for at least 15 minutes. Thus, copper alloys containing 25 to 35% zinc, especially cartridge brass (CDA Alloy No. 260), a copper base alloy containing about 30% zinc and the balance essentially copper, belong to the class of low stacking fault energy alloys suitable for texture modification and improvements in bend and strength properties in accordance with the process of the present invention. The recrystallization annealing step or RGR anneal for these alloys should be conducted at a metal temperature of from 370° C. to 450° C. preferably for at least 15 minutes. The restricted temperature range for alloys such as CDA Alloy 260 in this step is necessitated by the absence of grain refiner in the material. Prior processing history is not significant. Copper alloys containing from about 2 to 3% aluminum, about 1 to 3% silicon and about 0.2 to 0.5% cobalt, such as CDA Alloy 638, a copper base alloy containing about 3.0% aluminum, 2.0% silicon, 0.4% cobalt and the balance essentially copper also belong to the class of low stacking fault energy alloys suitable for the process of the present invention. Alloys such as CDA Alloy 638, on the other hand, may utilize a broader metal temperature range in the recrystallization annealing step of from 400° C. to 600° C. in view of the fact that these alloys are grain refined. Other representative recrystallization annealing metal temperatures are: CDA Alloy 510 — 450° C. to 550° C.; CDA Alloy 688 — 400° C. to 600° C.; and CDA Alloy 521 — 440° C. to 525° C.

Thus, it can be seen that the recrystallization annealing step must obtain full recrystallization and must provide a fine grain size less than 0.015 mm. In general one restricts the grain size in this step in order to provide higher strength after cold rolling for a given amount of reduction and also to intensify texture formation.

The fully recrystallized, fine grain material is then subjected to a critical cold working step utilizing at least 60% cold reduction, and preferably at least 70% cold reduction. Thus, the material after the cold reduction step is provided with high strength going into the annealing step which follows. This is significant in obtaining the desirable combination of properties in the resultant product. One uses a high cold reduction in this step in order to provide high strength going into the annealing step and also to intensify the texture of the material.

Following the critical cold reduction step, the material is given an RF or ready to finish anneal at a metal temperature of from 280° C. to 425° C. for a period of time of preferably at least 15 minutes to obtain a non-random texture with a plastic strain ratio measured 90° to the rolling direction of less than about 0.75. One can use either bell or continuous strip annealing techniques. When continuous strip annealing techniques are employed, one uses very short treatment times at higher temperatures, with the treatment being selected so that the resultant effect on the metal is as if the metal were subjected to a temperature of from 280° C. to 425° C. for at least 15 minutes, i.e., the metal temperature is effectively from 280° C. to 425° C. for at least 15 minutes. This annealing step is a recovery anneal and one obtains only partial softening so as to retain strength properties of the material and to provide a non-random texture characterized by a low R value in the transverse direction. The grain structure after this step is either unrecrystallized or partially recrystallized, i.e., one does not obtain full recrystallization in this step, although minor amounts of recrystallization may be tolerated within the limits of metallurgical practice. Naturally, the exact conditions for this annealing step will vary depending upon the particular copper alloy employed and its particular alloying additions. Thus, copper alloys containing 25–35% zinc, such as CDA Alloy 260, utilize annealing metal temperatures in this step of between 280° C. and 360° C. Copper alloys containing from about 2 to 3% aluminum, about 1 to 3% silicon and about 0.2 to 0.5% cobalt, such as CDA Alloy 638, utilize annealing metal temperatures in this step of between 330° C. and 415° C. Copper alloys such as CDA Alloy 688 utilize annealing metal temperatures from 310° C. to 485° C., CDA Alloy 510 from 330° C. to 415° C., and CDA Alloy 521 from 350° C. to 425° C.

The final processing step in the process of the present invention is the final cold reduction which must be less than about 40%. This is necessary in order to provide high strength in the final product and not introduce unfavorable deformation textures.

The process of the present invention and improvements resulting therefrom will be more readily apparent from a consideration of the following illustrative examples.

EXAMPLE I

Cartridge brass (CDA Alloy No. 260), a copper base alloy containing about 30% zinc and the balance essentially copper, was processed in the conventional manner as follows. The alloy was hot rolled, cold rolled, annealed at 490° C. for 1 hour, cold rolled 30%, annealed at 415° C. for 1 hour, and finally cold rolled. The R values were measured after the 415° C. — 1 hour anneal (RF anneal) and the values are set forth in Table I below. The subscripts $_0$, $_{45}$, and $_{90}$ refer to the angle and degrees from the rolling direction at which the R value was measured.

TABLE 1

| R Values Measured at 415° C/1 Hour Anneal | | |
|---|---|---|
| $R_0$ | $R_{45}$ | $R_{90}$ |
| 0.93 | 0.98 | 0.96 |

It is noted that the R values are substantially the same in all three directions of the sheet, meaning that the texture is random.

EXAMPLE II

The alloy of Example I was processed in accordance with the present invention in order to obtain a non-random texture after the RF anneal such that the R value is highest in the 0° direction and lowest in the 90° direction. The material was processed by hot rolling, cold rolling, annealing at 385° C for 1 hour, cold rolling 75%, annealing at 350° C for 1 hour, and finally cold rolling. The R values are shown in Table II below.

TABLE II

| R Values Measured at 350° C/1 Hour Anneal | | |
|---|---|---|
| $R_0$ | $R_{45}$ | $R_{90}$ |
| 1.18 | 0.95 | 0.60 |

It is clearly noted from the foregoing data that a non-random texture is obtain after the RF anneal. Such a texture is highly desirable in providing improvements in the rolled tempers.

EXAMPLE III

Alloys of Example I were obtained in the hot rolled condition. These alloys were processed in accordance with the following general processing schedule to provide finished metal at 0.030 inch gage as follows: cold roll; recrystallization or RGR anneal; cold roll (CR(1)); ready to finish or RF anneal; and final cold roll to final gage. The steps of importance in this processing cycle to develop the desired texture after the RF anneal are the RGR anneal, CR(1) and RF anneal. The final cold reduction is also important in developing final strength and bend properties. Several processing variations were employed. Three different temperatures were used for the RGR anneal of 300° C, 350° C and 410° C. Three different temperatures for the RGR anneal were utilized of 400° C, 450° C and 490° C. Three cold reductions of 60%, 75% and 87.5% were used and cold rolled and four final cold rolls of 20%, 30%, 40% and 60% were used.

The detailed schemes with the values of annealing temperatures are given in Table III below. Table III below also specifies the comparative processing (CP) scheme for random texture similar to Example I.

Table IV below shows the properties obtained utilizing a reduction of 60%, 75% and 87.5% for cold roll (CR(1)) and a final cold roll of 20%. Table V below shows the data with a final cold roll of 30%, and Table VI shows the data with a final cold roll of 40%. All of these tables also show comparative processing values where final cold rolls of 30%, 50% and 60% were employed to achieve equivalent strengths. Tensile strengths and minimum bend radius values were determined after the final step of each process. The bend test compares the bend characteristics of samples bent over increasingly sharp radii until fracture is noted. The smallest radius at which no fracture is observed is called the minimum bend radius or MBR. When the bend axis is perpendicular to the rolling direction it is called "good way bend," and parallel to the rolling direction is called the "bad way bend."

TABLE III

| SPECIFIC PROCESSING SCHEMES FOR IMPROVED BEND-STRENGTH COMBINATIONS | |
|---|---|
| A-300° C: | HR + CR + 400° C + CR(1) + 300° C + Final Cold Rolling |
| A-350° C: | HR + CR + 400° C + CR(1) + 350° C + Final Cold Rolling |
| A-410° C: | HR + CR + 400° C + CR(1) + 410° C + Final Cold Rolling |
| B-300° C: | HR + CR + 450° C + CR(1) + 300° C + Final Cold Rolling |
| B-350° C: | HR + CR + 450° C + CR(1) + 350° C + Final Cold Rolling |
| C-300° C: | HR + CR + 490° C + CR(1) + 300° C + Final Cold Rolling |
| C-350° C: | HR + CR + 490° C + CR(1) + 350° C + Final Cold Rolling |
| C-410° C: | HR + CR + 490° C + CR(1) + 410° C + Final Cold Rolling |
| CP: | HR + CR + 490° C + CR 30% + 410° C + Final Cold Rolling |

Note:
All annealing treatments were for 1 hour in the laboratory.

TABLE IV

| BEND-STRENGTH COMBINATIONS FOR CDA 260 FOR THE IMPROVED BEND PROCESS | | | | |
|---|---|---|---|---|
| | Final CR = 20% | | MBR*, 64th | |
| Ident | CR (1) | Long. UTS, ksi | Long. | Trans. |
| A-300° C | 60 | 86 | 3 | 4 |
| | 75 | 87.5 | 3 | 3 |
| | 87.5 | 88 | 3 | 3 |
| A-350° C | 60 | 80.8 | 2–3 | 3 |
| | 75 | 81.8 | 2–3 | 3 |
| | 87.5 | 84.8 | 2–3 | 3 |
| A-410° C | 75 | 77.3 | 2–3 | 3 |
| B-300° C | 60 | 79.5 | 2 | 3 |
| | 75 | 83.5 | 3 | 3 |
| | 87.5 | 85.5 | 3 | 3 |
| B-350° C | 60 | 75.0 | 2 | 2 |
| | 75 | 80.0 | 3 | 3 |

TABLE IV-continued

| BEND-STRENGTH COMBINATIONS FOR CDA 260 FOR THE IMPROVED BEND PROCESS | | | | |
|---|---|---|---|---|
| | Final CR = 20% | | MBR*, 64th | |
| Ident | CR (1) | Long. UTS, ksi | Long. | Trans. |
| | 87.5 | 83.3 | 3 | 3 |
| C-300° C | 60 | 80.0 | 3–4 | 3–4 |
| | 75 | 81.6 | 3 | 3 |
| | 87.5 | 85.8 | 3 | 3–4 |
| C-410° C | 75 | 74.3 | 2 | 2 |
| CP** | — | 77.0 | 2–3 | 4 |

*0.030 inch gage
**CP is comparative processing for random texture with 30% final cold reduction

TABLE V

| BEND-STRENGTH COMBINATIONS FOR CDA 260 FOR THE IMPROVED BEND PROCESS | | | | |
|---|---|---|---|---|
| | Final CR = 30% | | MBR*, 64th | |
| Ident | CR (1) | Long. UTS, ksi | Long. | Trans. |
| A-300° C | 60 | 94.0 | 4–5 | 8 |
| | 75 | 95.3 | 4–5 | 7 |
| | 87.5 | 96.0 | 4–5 | 8 |
| A-350° C | 60 | 91.0 | 3–4 | 7–8 |
| | 75 | 92.8 | 4 | 7–8 |
| | 87.5 | 93.0 | 3–4 | 7–8 |
| A-410° C | 75 | 93.0** | 6–7 | 10–12 |
| B-300° C | 60 | 92.0 | 4–5 | 8 |
| | 75 | 95.5 | 4–5 | 8 |
| | 87.5 | 95.0 | 4 | 8–10 |
| B-350° C | 60 | 88.5 | 4–5 | 8 |
| | 75 | 91.4 | 4–5 | 8 |
| | 87.5 | 92.0 | 4–5 | 8 |
| C-300° C | 60 | 91.1 | 4–5 | 10–12 |
| | 75 | 94.3 | 4–5 | 7–8 |
| | 87.5 | 96.0 | 4–5 | 7–8 |
| C-350° C | 60 | 86.2 | 4 | 8–10 |
| | 75 | 90.8 | 4–5 | 8–10 |
| | 87.5 | 93.8 | 4–5 | 8 |
| C-410° C | 75 | 92.5** | 5 | 10–12 |
| CP*** | Final CR=50% | 90 | 7 | 12 |
| | Final CR=60% | 94 | 8 | 16 |

*0.030 inch gage
**Final CR=40% for these conditions
***CP=comparative processing - final CR-50 or 60% as indicated

TABLE VI

| BEND-STRENGTH FOR CDA 260 FOR THE IMPROVED BEND PROCESS | | | | |
|---|---|---|---|---|
| | Final CR = 40% | | MBR*, 64th | |
| Ident | CR (1) | Long. UTS, ksi | Long. | Trans. |
| A-300° C | 60 | 101.0 | 7 | 12–16 |
| | 75 | 99.0 | 5–6 | 12–16 |
| A-350° C | 96.8 | 5–6 | 12 | |
| 60 | | | | |
| | 75 | 97.8 | 5–6 | 12 |
| A-410° C | 75 | 103.0** | 8–10 | 16 |
| C-300° C | 60 | 95.3 | 6–7 | 12 |
| | 75 | 99.0 | 5–6 | 12–16 |
| C-350° C | 60 | 92.8 | 7–8 | 12 |
| | 75 | 96.5 | 6–7 | 12–16 |
| C-410° C | 75 | 101.5** | 7–8 | 16 |
| CP*** | Final CR=50% | 90.0 | 7 | 12 |
| | Final CR=60% | 94.0 | 8 | 16 |

*0.030 inch gage
**Final CR=60% for these conditions
***CP=comparative processing - final CR=50 or 60% as indicated The foregoing results clearly show that there is significant improvement in the combination of high strength and high bend ductility obtained in accordance with the process of the present invention.

EXAMPLE IV

The following example shows that the strength bend combinations are sensitive to the RF anneal conditions, with all other steps of the process held constant. Table VII below shows the ultimate tensile strength and minimum bend radius for Alloy CDA 260 for RF anneal from 300° to 410° C, with the RGR anneal held constant at 400° C and cold rolled held constant at 75%. Comparison is also made with the comparative process results at equivalent strength. The following data clearly shows that all of the material processed in accordance with the present invention have better bend to strength combinations than material processed in accordance with the comparative processing; however, clearly RF anneals from 300° to 350° C show the largest improvement for CDA Alloy 260.

TABLE VII

| EFFECT OF READY TO FINISH ANNEAL ON BEND-STRENGTH COMBINATIONS | | | | |
|---|---|---|---|---|
| | RF | | MBR, 64th, 0.030" Gage | |
| Process Code | Anneal, ° C | UTS, ksi | GW | BW |
| A-300 | 300 | 95.3 | 4–5 | 7 |
| A-350 | 350 | 92.8 | 4 | 7–8 |
| A-410 | 410 | 93.0 | 6–7 | 10–12 |
| CP | | 94.0 | 8 | 16 |

EXAMPLE V

This example shows that the bend strength combination is sensitive to the RGR temperature with the other steps of the improved process of the present invention held constant at 350° C for the RF anneal and 75% for cold rolled. The RGR anneal was varied from 400° to 490° C as shown in Table VIII below. The data in the table shows the ultimate tensile strength and minimum bend radius values as a function of the RGR anneal. Comparison is made with comparative process results at equivalent strength. The following data clearly shows that improved bend strength combinations were obtained in accordance with the process of the present invention over that processed in accordance with comparative processing for the entire range of RGR anneals; however, the greatest improvement in properties occurred in RGR anneals between 400° and 450° C for CDA Alloy 260.

TABLE VIII

| EFFECT OF RGR ANNEAL ON BEND-STRENGTH COMBINATIONS | | | | |
|---|---|---|---|---|
| | RGR | | MBR, 64th, 0.030" Gage | |
| Process Code | Anneal, ° C | UTS, ksi | GW | BW |
| A-350 | 400 | 92.8 | 4 | 7–8 |
| B-350 | 450 | 91.4 | 4–5 | 8 |
| C-350 | 490 | 90.8 | 4–5 | 8–10 |
| CP | | 90.0 | 7 | 12 |

EXAMPLE VI

This example shows the effect of percent reduction before the RF anneal on strenth - bend combinations in Alloy CDA 260 with all other steps in the process of the present invention being held constant. A 450° C RGR anneal and a 350° C RF anneal were employed. Table IX gives the resultant ultimate tensile strength and minimum bend radius for these materials, as well as data for the comparative processing. It can be seen that all of the improved process schedules of the present invention have better bend to strength combinations than the comparative process. The greatest improvement, however, clearly occurs at the higher reductions in excess of 70% cold reduction.

TABLE IX

| EFFECT OF CR(1) ON BEND-STRENGTH COMBINATIONS | | | | |
|---|---|---|---|---|
| | | | MBR, 64th, 0.030" Gage | |
| Process Code | CR (1) % | UTS, ksi | GW | BW |
| B-350 | 60 | 88.5 | 4–5 | 8 |
| B-350 | 75 | 91.4 | 4–5 | 8 |
| B-350 | 87.5 | 92.0 | 4–5 | 8 |

TABLE IX-continued

| EFFECT OF CR(1) ON BEND-STRENGTH COMBINATIONS | | | | |
|---|---|---|---|---|
| | | | MBR, 64th, 0.030" Gage | |
| Process Code | CR (1) % | UTS, ksi | GW | BW |
| CP | | 90.0 | 7 | 12 |

EXAMPLE VII

The following example shows that the process of the present invention may be used with CDA Alloy 638. CDA Alloy 638 having a composition of about 2% silicon, 3.0% aluminum, 0.4% cobalt and the balance copper was provided in the hot rolled condition. The material was processed as set forth in Table X below with Processes A to D representing the processing of the present invention and Processes CP representing comparative processing as in the foregoing examples. Tensile strength and minimum bend radius were determined after a final reduction of 20% and 30%. These results are shown in Table XI below.

TABLE X

| PROCESSING FOR CDA 638 | |
|---|---|
| Ident | |
| A | HR + CR 77% + 550° C + CR 60% + 350° C + CR 20% |
| B | HR + CR 62% + 500° C + CR 75% + 400° C + CR 20% |
| C | HR + CR 62% + 550° C + CR 75% + 350° C + CR 20% |
| D | HR + CR 85% + 550° C + CR 40% + 350° C + CR 20% |
| CP-½Hd | HR + CR 91% + 550° C + CR 20% |
| CP-¾Hd | HR + CR 89% + 550° C + CR 30% |

Note:
All annealing treatments were for 1 hour in the laboratory.

TABLE XI

| BEND-STRENGTH COMBINATIONS FOR CDA 638 | | | |
|---|---|---|---|
| | | MBR*, 64th | |
| Ident | Long. UTS, ksi | Long. | Trans. |
| A | 107 | 3 | 5 |
| B | 113 | 3 | 7 |
| C | 110 | 3 | 6 |
| D | 110 | 3 | 7 |
| CP-½Hd** | 106 | 4 | 8 |
| CP-¾Hd** | 117 | 6 | 12 |

*0.030 inch gage
**CP=comparative process

The foregoing data clearly shows that improved results are obtained on Alloy CDA 638 in accordance with the process of the present invention.

It is a significant advantage of the present invention that material prepared in accordance with the present invention at final gage in the cold worked condition has an ultimate plane strain tensile strength in the transverse direction of from 0 to 12% greater than the longitudinal ultimate tensile strength in the conventional tensile test. The conventional or standard tensile test involves pulling a specimen in a specified length direction and involves corresponding simultaneous contractions of the specimen in the width and thickness direction. In a plane strain tensile test, on the other hand, extension of the specimen in the length direction is only accompanied by contraction in the thickness direction. This is accomplished by machining a notch in the face of the specimen.

The plane strain tensile test is of interest as the conventional or standard tensile test does not reflect the effect of texture (R value) on the ultimate tensile strength. The plane strain test does reflect the effect of texture on tensile strength.

Conventional material processed outside of the processing of the present invention will have a texture such that the ultimate plane strain tensile strength in the cold worked condition in the transverse direction is at least 15% higher than the longitudinal ultimate tensile strength in the conventional tensile test. As indicated above, the material processed in accordance with the present invention at final gage in the cold worked condition has an ultimate plane strain tensile strength in the transverse direction from 0 to 12% greater than the longitudinal ultimate tensile strength in the conventional tensile test. The higher strength values of conventional materials in the plane strain test are undesirably associated with lower bend ductility values. Thus, the lower strength values in the plane strain test of the material of the present invention represent a significant improvement with respect to bend ductility.

The ultimate strength measured in plane strain is representative of that expected in bending. The conventional tensile values do not represent the values expected in bending. Therefore, a material can have comparable conventional tensile values, but markedly different plane strain values and as a corollary thereto markedly different bend characteristics. The foregoing will be illustrated in the following representative example.

EXAMPLE VIII

In the following example cartridge brass (CDA Alloy No. 260) was processed in a conventional manner as follows: The alloy was hot rolled, cold rolled, annealed at 490° C for 1 hour, cold rolled 30%, annealed at 410° C for 1 hour and finally cold rolled to desired gage and temper. In the table which is given below this material is identified as Alloy E. As a comparison, the same alloy was processed in accordance with the present invention as follows: The alloy was hot rolled, cold rolled, annealed at 400° C for 1 hour, cold rolled 80%, annealed at 350° C for 1 hour, and finally cold rolled to desired gage and temper. In the data which follows, this material was identified as Alloy F.

The resultant materials were tested as previously described for conventional longitudinal ultimate tensile strength and for ultimate plane strain tensile strength in the transverse direction. Also, the ratio of the ultimate plane strain tensile strength to conventional ultimate tensile strength was calculated. The data is set forth in Table XII below.

TABLE XII

| Longitudinal Ultimate Tensile Strength and Ultimate Plane Strain Tensile Strength | | | |
|---|---|---|---|
| Ident. | Longitudinal Ultimate Tensile Strength, ksi (UTS) | Transverse Ultimate Plane Strain Strength, ksi (UPSS) | UPSS/UTS |
| Alloy E | 90.0 | 108.5 | 1.20 |
| Alloy E | 97.0 | 113.0 | 1.16 |
| Alloy F | 87.5 | 90.0 | 1.03 |

TABLE XII-continued

| Longitudinal Ultimate Tensile Strength and Ultimate Plane Strain Tensile Strength | | | |
|---|---|---|---|
| Ident. | Longitudinal Ultimate Tensile Strength, ksi (UTS) | Transverse Ultimate Plane Strain Strength, ksi (UPSS) | UPSS/UTS |
| Alloy F | 100.5 | 106.0 | 1.06 |

The foregoing results clearly show that the process of the present invention results in an ultimate plane strain tensile strength in the transverse direction of from 0 to 12% greater than the longitudinal ultimate tensile strength in the conventional tensile test; whereas, conventional processing results in a texture such that the ultimate plane strain tensile strength in the cold worked condition in the transverse direction is at least 15% higher than the longitudinal ultimate tensile strength in the conventional tensile test.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An annealed copper base alloy having a high bend ductility, said alloy having a stacking fault energy of less than 30 ergs per square centimeter, said alloy consisting essentially of a first element selected from the group consisting of about 2 to 12% aluminum, about 2 to 6% germanium, about 2 to 10% gallium, about 3 to 12% indium, about 1 to 5% silicon, about 4 to 12% tin, about 8 to 37% zinc, balance essentially copper, said alloy having a non-random texture with a plastic strain ratio measured 90° to the rolling direction of less than about 0.75, wherein the grain structure is either unrecrystallized or partially recrystallized.

2. A high strength alloy according to claim 1 in the cold worked condition and has an ultimate plane strain tensile strength in the transverse direction of from 0 to 12% greater than the longitudinal ultimate tensile strength.

3. An alloy according to claim 2 containing from 25 to 35% zinc.

4. An alloy according to claim 2 containing from 2 to 3% aluminum, from 1 to 3% silicon, from 0.2 to 0.5% cobalt and the balance essentially copper.

5. An alloy according to claim 2 containing at least one second element different from said first element selected from the group consisting of about 0.001 to 10% aluminum, about 0.001 to 4% germanium, about 0.001 to 8% gallium, about 0.001 to 10% indium, about 0.001 to 4% silicon, about 0.001 to 10% tin, about 0.001 to 37% zinc, about 0.001 to 25% nickel, about 0.001 to 0.4% phosphorus, about 0.001 to 5% iron, about 0.001 to 5% cobalt, about 0.001 to 5% zirconium, about 0.001 to 10% manganese and mixtures thereof.

6. A copper base alloy having a high bend ductility, said alloy comprising the product of a process comprising:

(a) providing a copper base alloy having a stacking fault energy of less than 30 ergs per square centimeter consisting essentially of a first element selected from the group consisting of about 2 to 12% aluminum, about 2 to 6% germanium, about 2 to 10% gallium, about 3 to 12% indium, about 1 to 5% silicon, about 4 to 12% tin, about 8 to 37% zinc, and the balance essentially copper wherein said alloy is fully recrystallized and has a fine grain size of less than 0.015 mm;

(b) cold working said alloy at least 60%;

(c) annealing said alloy at a metal temperature of from 280° to 425° C to obtain a non-random texture with a plastic strain ratio measured 90° to the rolling direction of less than about 0.75; wherein the grain structure after said annealing is either unrecrystallized or partially recrystallized; and (d) finally cold working said alloy less than 40%.

* * * * *